US007921898B2

(12) United States Patent
Brioschi

(10) Patent No.: US 7,921,898 B2
(45) Date of Patent: Apr. 12, 2011

(54) PNEUMATIC AUTOMATION SYSTEM FOR MOBILE SCREENS

(75) Inventor: Roberto Brioschi, Borgoticino (IT)

(73) Assignee: Gianus S.p.A., Milan (IT)

( * ) Notice: Subject to any disclaimer, the term of this patent is extended or adjusted under 35 U.S.C. 154(b) by 594 days.

(21) Appl. No.: 11/919,684

(22) PCT Filed: May 19, 2005

(86) PCT No.: PCT/IT2005/000282

§ 371 (c)(1),
(2), (4) Date: Oct. 31, 2007

(87) PCT Pub. No.: WO2006/123371

PCT Pub. Date: Nov. 23, 2006

(65) Prior Publication Data

US 2009/0088904 A1 Apr. 2, 2009

(51) Int. Cl.
*E06B 9/56* (2006.01)

(52) U.S. Cl. ..... 160/311; 160/265

(58) Field of Classification Search ..... 160/311, 160/265, 331, 168.1 P, 188, 310, 312
See application file for complete search history.

(56) References Cited

U.S. PATENT DOCUMENTS

| | | | | | |
|---|---|---|---|---|---|
| 1,544,751 | A | * | 7/1925 | Haynes et al. | 49/104 |
| 1,741,871 | A | * | 12/1929 | Mitchell | 92/33 |
| 1,751,735 | A | * | 3/1930 | Hicinbothem | 160/265 |
| 1,772,892 | A | * | 8/1930 | Green | 160/303 |
| 1,814,455 | A | * | 7/1931 | Phillips | 160/311 |
| 1,837,129 | A | | 12/1931 | Maples | |
| 1,891,098 | A | * | 12/1932 | Kurth | 160/265 |
| 1,944,454 | A | * | 1/1934 | Park | 160/265 |
| 3,574,022 | A | | 4/1971 | Lampert | |
| 4,296,570 | A | * | 10/1981 | Balbach et al. | 49/360 |
| 4,342,355 | A | * | 8/1982 | Geller et al. | 160/331 |
| 4,887,660 | A | | 12/1989 | Kraus | |
| 4,896,714 | A | * | 1/1990 | Ellis | 160/311 |
| 5,031,574 | A | * | 7/1991 | McDowell | 119/448 |
| 5,107,677 | A | * | 4/1992 | Ribaudo | 60/473 |
| 5,345,991 | A | * | 9/1994 | Huber et al. | 160/122 |
| 5,791,087 | A | * | 8/1998 | Strab | 49/360 |
| 7,219,711 | B2 | * | 5/2007 | Keller et al. | 160/213 |
| 2003/0015302 | A1 | * | 1/2003 | Pessina et al. | 160/331 |

FOREIGN PATENT DOCUMENTS

| | | | |
|---|---|---|---|
| DE | 8 807 | A | 6/1879 |
| DE | 13 606 | A | 6/1880 |
| DE | 100 07 222 | A1 | 8/2001 |
| EP | 0 417 373 | A | 3/1991 |
| EP | 1 491 701 | A | 12/2004 |
| FR | 1 006 934 | A | 4/1952 |

* cited by examiner

*Primary Examiner* — David Purol
(74) *Attorney, Agent, or Firm* — Edwards Angell Palmer & Dodge LLP; Peter C. Lauro, Esq.; Brian R. Landry

(57) ABSTRACT

A pneumatic automation system (1) is disclosed for mobile screens (2) comprising at least one of the mobile screens (2), a device for compressing a control fluid, a device for channeling and checking the control fluid, a device for pneumatically actuating a movement of the mobile screen (2) equipped with at least one sliding cursor (4) controlled by the control fluid and supplied by the compressing device through said channeling and checking means, and a device for connecting the cursor (4) with the mobile screen (2).

19 Claims, 4 Drawing Sheets

FIG. 7
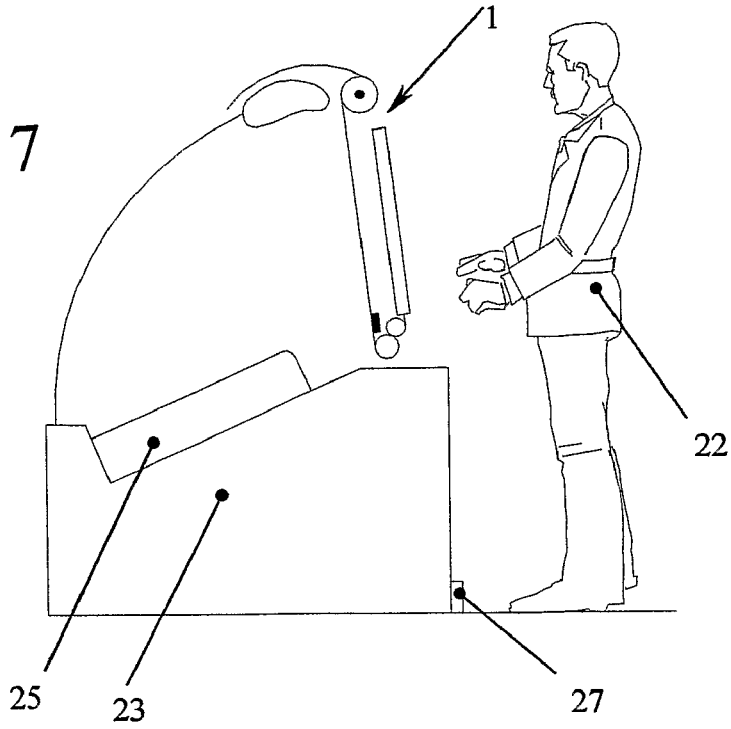
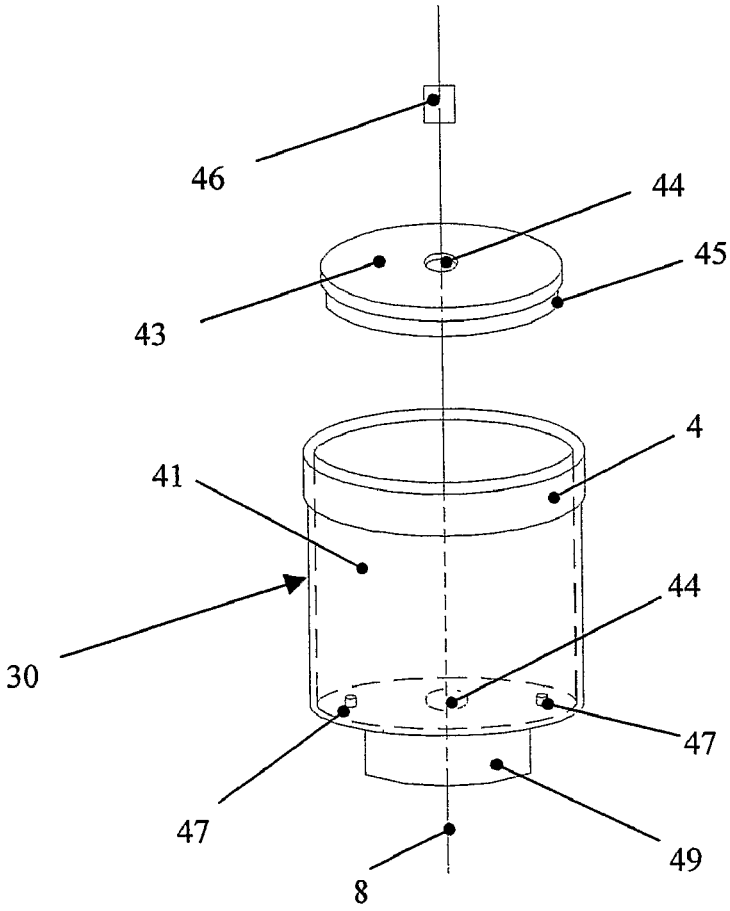
FIG. 8

PNEUMATIC AUTOMATION SYSTEM FOR MOBILE SCREENS

This application is the U.S. national phase application, pursuant to 35 U.S.C. §371, of PCT international application Ser. No. PCT/IT2005/000282, filed May 19, 2005, designating the United States and published in English on Nov. 23, 2006 as publication WO 2006/123371 A1. The entire contents of the aforementioned patent application are incorporated herein by this reference.

BACKGROUND OF THE INVENTION

The present invention refers to a system for pneumatically automating mobile sliding and/or rolling screens, particularly for sun screens, curtains, mosquito-nets, thermal screens, panels, sliding doors and windows, windows both for civil and for industrial buildings.

The need for automating rolling sun screens and/or mosquito nets is particularly felt under different situations, in particular when:

- it is difficult to reach the screen, for example like when a window is very high or is arranged in a staircase room;
- the screen is part of an extended group of similar apparata, that must be able to be controlled in a centralised way, for example in case of an extended darkening system in a building with offices;
- the screen must be frequently driven, maybe by an operator with engaged hands, such as, for example, in the kitchen entry of a restaurant, a shop entry, the access for exchanging materials to a cash counter or a motorway fare stations (in order to limit the cooling of the environment in which the operator resides);
- the screen must be able to be quickly driven but with an external control, in order to avoid unwanted accesses, such as, for example, in case of access to a working area with moderate risks even only for the operator's hands, like an area with projection of liquids-chips in an industrial process, an access area to a tunnel-type dish-washing machine for restaurants (replacing the plastic bands, that come in contact with kitchenware and surely are not sterile);
- the opening to be protected is a door; in this case the technically more reliable arrangement is, as known, a vertical rolling screen; however, this arrangement is uncomfortable for the drivability, compelling the user to bend down for closing it and, if the product has not a braked opening, also for its opening. The currently adopted arrangement is an horizontally-opening screen, which can be easily driven, but that however has the inconvenience of having a housing outline of the screen on the ground, such outline being an obstacle to a passage even if of reduced sizes;
- it is desired to adjust the brightness inside a room quickly, repeatedly and silently in order not to cause any disturbance, checking the sun screen position by coupling the automation system to a brightness sensor and to a position sensor;
- it is desired to realise an effectively operating energy saving system. In order to realise such effect, both in case of heating and, more so in case of air conditioning, it is necessary to be able to position the screen outside. In case of heating, in fact, it is necessary to create a tepid air chamber between the window containing the heated room and the outside, in order to expose to the external temperature a surface with intermediate temperature between the internal temperature and the temperature (in case of a typical winter evening equal to 3° K) of the bottom radiation. Since the heat propagation by radiance is proportional to the square of the temperature difference between the two heat sources, it is immediately evident that breaking the heat propagation with an intermediate temperature is extremely good (10*10=100+10*10=100, is much lower than 20*20=400!). With an internal screen, instead, the screen temperature remains much nearer to the room temperature, greatly reducing the effect. In case of conditioning, instead, the advantage of having an external screen is that, one the visible radiation has managed to enter the room, it is converted into an infrared radiation on internal curtains with the effect that it is not able any more to go out of the glass that has now become opaque. This effect can be reduced by adopting an aluminium-coated screen, but not in a final way. Therefore, in order to adopt an interesting saving strategy, it is necessary to be able to use and external screen that is automatic, quick, silent and, above all, reliable, given that, due to its external location, every type of maintenance would be extremely uncomfortable in the majority of times. Moreover, being able to couple the automation system with a presence sensor, it would be possible to keep the darkening screens closed when there is no human activity in the room, and open them as soon as the access door is opened. Also for this application, silent, reliable and discrete automation systems for darkening screens are preferable;
- the screen, in particular when it is a mosquito net, is placed external to the window or door frame. In this case, it would be desirable that, when the frame is closed, the mosquito net is opened, in order to limit its aesthetically unpleasant view. However, when the frame is opened, it is important to close the mosquito net in order to avoid, especially during summer nights, the entry of insects. By manually driving the screen, however, it is necessary to first open the window and then to lower the screen, or vice versa, to first open the screen and then close the window, thereby leaving a time interval in which both mosquito net and frame are open, such interval being more than enough to allow mosquitoes to enter. Due to an efficient mosquito net automation system, it would however be possible to avoid this, since the screen could be easily driven from the inside. Moreover, if the automation system could guarantee a high mosquito net actuation quickness and a high level of intrinsic safety, it would be possible to drive the mosquito net directly by actuating the window, guaranteeing its perfect closure before the window is actually opened, making its use still easier and more efficient.

In the current art, a rolling screen currently consists in a box placed in an upper position with respect to the opening to be protected, containing a generally metal tube, on which the textile screen is wound.

Laterally, on the opening sides, two generally metal guides are located, which allow the screen dragged by its handle bar to correctly descend and to remain in its correct position.

Further object of the guides is that, through suitable gaskets, or even simply a labyrinth path, light does not laterally enter in case of a sun screen and insect, in case of a mosquito net, are not able to pass by the net sides. In the winding tube, a torsional spring is further contained, with the purpose of balancing or also rewinding the textile cloth.

The problem of automating darkening screens and mosquito nets is currently solved by electrically motoring them. In particular in standard systems, the motor is contained in the above tube, with evident dimensional limits, and the cloth descends when subjected to the only tension, typically a scarce one, induced by the handle bar weight. This configuration is subjected to several problems, and in any case to high installation costs (minimum 100€ only for the motor of an automation system for a window rolling screen). In particular, known automation systems through electric motoring have the following intrinsic and assembling disadvantages that are strongly negative:

- they have scarce reliability, since the necessary power density ($W/cm^3$) is very high, not because a high power is required, but because the space inside the tube is very small: this compels, for rather heavy systems, to adopt exaggeratedly big tubes with the disadvantage of having big final overall sizes, anyway resulting in being able as a maximum to perform few consecutive maneuvers (as a limit 2 or 3) before the motor enters in thermal protection or is damaged beyond repair;
- they are noisy: since the motor has to be made with small sizes, it is necessary to rotate it at very high speeds and then equip it with a reducer, typically of the epicyclic type, that, in order to remain inexpensive, is always made in a version with straight teeth, such characteristic making it extremely noisy; anyway, even by equipping the motor with a high-range speed reducer, the silent operation is well far from being deemed tolerable in a civil application (suffice it to think that the typical manoeuvre time of a screen is a night, probably in a sleeping room);
- they are costly: always due to the high necessary power density, they are costly technologic products. Typically, small-sized motors are direct current motors with permanent magnets; if it is not possible to do without them, asynchronous single-phase motors are adopted, adding the further disadvantage (in addition to the obvious one of high sizes) of not being able to adjust the speed unless very costly inverters, of a typical industrial application, are used;
- they have a limited life, which makes them absolutely unsuitable to operate in a real automatic system, unless they are seldom used for driving unreachable screens, or for reasons of appearance in very costly buildings, at the expense, in addition to installation costs, of frequent replacements;
- they are slow due to the necessary high reduction ratio to allow the limited power to move the screen;
- they need an accurate limit switches adjustment since a wrong adjustment would imply, in the best case, an incomplete screen opening/closing or a screen de-tensioning in its close deposition and, in the worst case, to a ratio-motor breakage due to the occurrence of the maximum-opening mechanical lock; moreover, at any time the lack of intervention of one of the limit stops occurred, an operating logic reversal would occur (namely the screen would be completely unwound to be then re-wound on the opposite part, generating the switching of the "open" limit switch with the "closed" one) with sure motor damages and an almost certain ratio-motor breakage;
- being equipped with an electric drive, in order to be able to be assembled on the outside (typical of a curtain, for example), they need a protection at least equal to IP55, absolutely out of discussion for an object for domestic use: from this, it is deduced that, apart from rare cases, installations performed outside (typically in "bricolage" works) are dangerous (for 220-110V models), or at least amenable to a short life;
- they are not adapted to move horizontal screens (typically roof windows), use in which they would find an ideal application, since it is this type of screen that is often reachable with difficulty. Such inadequacy results from the cloth tensioning that is only given by the weight of the handle bar that ends the cloth that, in case of a vertical movement, drags downwards the screen in order to allow its closure: instead, in case of an horizontal movement, the handle bar traction action would obviously have no effect and the screen would not be able to be closed, unless the screen has a sufficient intrinsic stiffness. In order to try and search to realise this type of applications, typically a second spring-loaded winding tube is placed on the screen base, that is connected with two tie-rods to the handle bar that, at that time, is in an intermediate position between two winding systems. The contrast between these two systems creates the necessary tension to support the cloth, while one of the two tubes, being further motored, provides the automation. All these additions further complicate the screen, making it still more costly, difficult to install and even more subjected to malfunctions.

There are automation systems that can guarantee a quick screen movement, but these are, such as for example in case of a linear axis driven by brushless motors, products with a clear industrial origin, characterised by high installation costs, and therefore scarcely complying with the need of an automation system that is available on a large scale.

Moreover, in all anyway known cases, being the screen left fall from its winding roll without other tensioning apart from its own weight and its own handle bar, the screen itself remains scarcely tensioned and tends to easily go out of its own guides, particularly in case of wind. Moreover, in existing systems, the handle bar freely slides in the guides, compensating possible window and door frame distortions only through a high clearance inside the guides themselves, consequently generating a scarce screen movement quality.

In all cases, anyway, no existing automation system guarantees enough quickness, reliability, inexpensiveness and operating safety to be able to solve one of the previously-described cases to be satisfied.

BRIEF SUMMARY OF THE INVENTION

Therefore, object of the present invention is solving the above prior art problems by providing a pneumatic automation system for sliding and windable mobile screens, in particular darkening screens, sun screens and mosquito nets, which allows a quick, silent, safe and reliable handling of the screen themselves and that, at the same time, can be more inexpensively manufactured and which further allows an easy and inexpensive adjustment of position and force and movement speed of the screen themselves.

The above and other objects and advantages of the invention, as will result from the following description, are obtained with a pneumatic automation system for mobile screens as claimed in claim 1. Preferred embodiments and non-trivial variations of the present invention are the subject matter of the dependent claims.

BRIEF DESCRIPTION OF THE SEVERAL VIEW OF THE DRAWING(S)

The present invention will be better described by some preferred embodiments, provided as a non-limiting example, with reference to the enclosed drawings, in which:

FIG. 7 shows a schematic perspective view of another embodiment of the pneumatic automation system for mobile screens according to the present invention; and FIG. 8 shows an exploded perspective view of a preferred element of an embodiment of the pneumatic automation system for mobile screens according to the present invention.

DETAILED DESCRIPTION OF THE INVENTION

With reference to the Figures, it is possible to note that the pneumatic automation system 1 for mobile screens 2 according to the present invention comprises:

- at least one mobile screen 2,
- means for compressing a control fluid;
- means for channeling and controlling the control fluid;
- pneumatic actuator means of the movement of the mobile screen 2 equipped with at least one sliding cursor driven by the control fluid and supplied by compressing means through the channeling and controlling means;
- means for connecting the cursor with the mobile screen 2.

As previously stated, the system 1 provides that the mobile screen 2 can indifferently be a darkening screen, a sun screen, a thermal screen, a window or door panel, a window or a mosquito net, both of the sliding and of the windable type.

Figure 1:
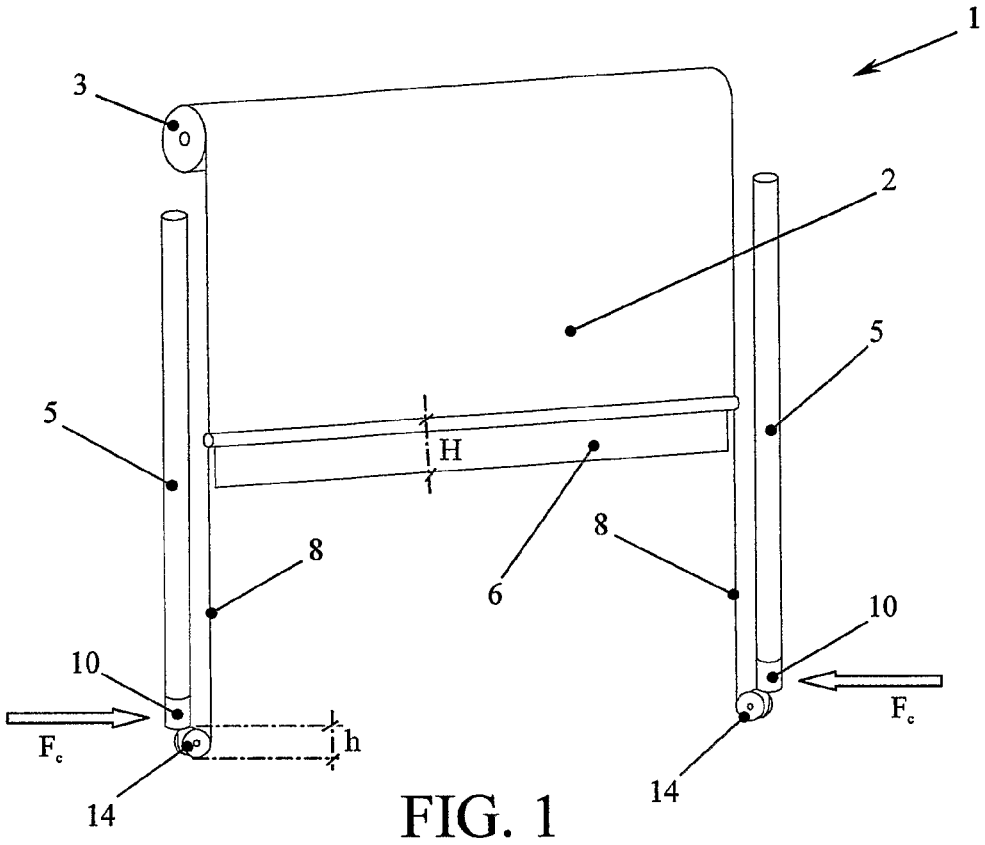
FIG. 1 shows a schematic perspective view of a preferred embodiment of the pneumatic automation system for mobile screens according to the present invention.
Figure 6:
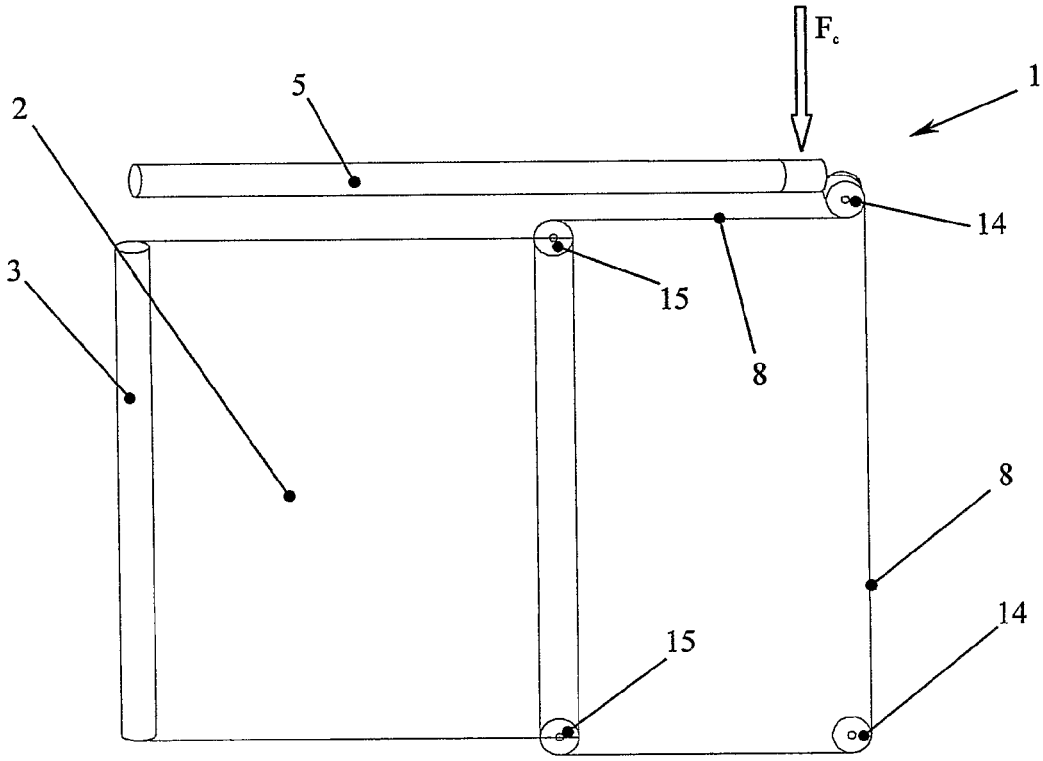
FIG. 6 shows a schematic perspective view of another embodiment of the pneumatic automation system for mobile screens according to the present invention.

FIGS. 1 and 6 show an application of the system 1 to a mobile screen 2 that is able to be wound around a winding drum 3 equipped with a known torsion spring. Particularly in FIG. 1, as a non-limiting example, the system 1 has been applied to a mobile screen 2 of the type with vertical movement. In particular, in this preferred embodiment, the pneumatic means for actuating the movement of the mobile screen 2 are two tubes 5 operating as pneumatic cylinders, each one of which has a preferably circular section and inside which the cursor slides under the thrust of the control fluid, the cursor being preferably equipped with adequate first sealing means adapted to prevent the control fluid blow-by inside the tube 5 itself. The cursor is connected to the mobile screen, and in the present embodiment to the handle bar 6 , by interposing the connecting means; the connecting means are preferably at least one cable 8 that goes out of a closing element 10 of the tube 5 through second sealing means, like a gasket, adapted to prevent the control fluid from going out of the tube 5 itself. The second sealing means are in their simplest and most preferred embodiment a gasket of the O-Ring type, preferably made of nitrile rubber, polyurethane, silicone or Viton, but other materials or other sealing arrangements are not excluded, such as a plurality of O-Ring gaskets or at least one lip-shaped gasket or any other type adapted for the purpose, possibly equipped with at least one stem- scraper whose purpose is keeping impurities away from the gaskets. The cable 8 , immediately after having gone out of the closing element 10 , can be returned by first return means, such as for example a pulley 14 , preferably of reduced sizes as will be seen afterwards, in order to reverse its direction and be arranged in the correct direction towards the winding drum 3 in order to be able to drag the handle bar 6 in its opening and closing stroke of the mobile screen 2. The mobile screen movement can be guided both by pneumatic actuator means and by known sliding guides.

The tube 5 can obviously be made of any material suitable for its purpose; preferably, it can be made of metal (of stainless steel if visible or when exceptional reliability features are required, or of aluminium possibly directly obtained from the guide outline extrusion when high economies are required, possibly of brass as compromise between the two needs).

If it is desired to operate with outlines made of plastic materials (as in case of coupling with PVC window and door frames), it is possible to adopt as tube 5 a plastic material, insulated or directly integrated into the sliding guide, for the main purpose of adapting the linear thermal expansion coefficients of materials. If anyway it is desired to operate with metal tubes, it will anyway be enough to leave the tube 5 free of sliding on suitable supports inside the sliding guide and equip it with an enough clearance in its length direction.

The control fluid is preferably air, but for particular applications the use of liquids or other substances at the gaseous state is not excluded.

The cursor is moved inside its own tube 5 by creating a suitable pressure difference between a first and second chamber defined in each tube 5 by the cursor itself and mutually insulated by first sealing means. The above compressing means of a control fluid are represented, here as a non-limiting example, by an air compressor: the control fluid pressurised by the compressing means is then suitably conveyed into the first and/or second chamber by the channeling and controlling means of the control fluid, represented by a system composed of a plurality of valves and ducts according to configurations that are substantially known to a skilled person in the art, according to the movements that have to be conferred to the mobile screen 2, namely opening, closing or intermediate positioning.

In order to obtain a good operation of the system 1, it is moreover mandatory that the tubes 5 are internally well lubricated in order to allow the optimum sliding of the cursor inside: such lubrication is however an operation that is not often easy, above all in case of very long tubes 5, and must be performed with extreme care. Moreover, it is not suitable to provide pre-greased tubes 5, since the lubricated surface would be amenable to the adhesion of any dirt (dust, chips, etc.) with which it came in contact when installing the system 1, unavoidably impairing the gasket life, or even seizing the cursor during its movement. In order to guarantee a perfect lubrication, it is therefore possible to equip the system 1 with a lubricant-dispensing device 30 integrated into the cursor 4 like the one shown in FIG. 8: in the cursor 4 a tank 41 is obtained, in which the charge of lubricant to be dispensed inside the tube 5, closed by a grease-pressing plate 43 preferably by interposing a gasket 45 , for example of the O-Ring type, adapted to slide inside the tank 41 and to press the lubricant inside under the traction effect of the cable 8 that crosses cursor 4 and tank 41, preferably through O-Ring gaskets 44 , in order to be constrained to the grease-pressing plate 43, for example through a terminal, a cable terminal or a block 46. The cursor 4 is then equipped with at least one hole 47 (FIG. 8 shows a device 30 in which the cursor 4 is equipped with two holes 47) next to the first sealing means and communicating with the tank 41 through which the lubricant pressurized by the grease-pressing plate 43 goes out, on which the traction force generated by the wire operates, being exactly distributed on the gasket 49 lip that represents an example the first sealing means. In order to then obtain a perfect lubrication, it will be enough after having installed the system 1, to perform an enough number of no-load maneuvers of the cursor 4 to uniformly dispense the lubricant on the whole internal surface of the tube 5.

FIG. 6 instead shows an application of the system 1 to a type of mobile screen 2 of the winding type with horizontal movement.

In this alternative arrangement, the above pneumatic actuator means of the mobile screen 2 movement are a single tube 5, preferably arranged parallel to the architrave of an opening, inside which the cursor connected to the mobile screen 2 slides through a double cable 8 returned by two return elements or pulleys 14.

In the embodiments in FIGS. 1 and 6, the pressurised control fluid is entered, as shown by arrow FC, into the first chamber through the closing element, while the second chamber is kept at ambient pressure; in this way, the cursor contained inside the tube 5, and to which the cable 8 is connected, is subjected to a pushing pneumatic force. This force pushes the cursor inside the tube 5 and forces the cable 8 to go back into the tube 5 itself, dragging the handle bar 6 and consequently the mobile screen 2, taking it towards its closing position by unwinding the winding drum 3. It is useful to remember here the importance of being able to exert a strong traction on the mobile screen 2 independently from the handle bar 6 weight, this, in external applications, allowing to have a greater wind resistance and making horizontal applications possible, of the roof window type, where the handle bar 6 weight would absolutely not tension the cloth of the mobile screen 2.

Another important aspect is given by the fact that the pulley 14 should have an extremely reduced diameter for the correct operation of the system 1: in fact, as pointed out in particular in FIG. 1, the height h of the closing element 10 and of the pulley 14 must be, in order to allow the mobile screen 2 to be completely closed, less that the height H of the handle bar 6; above all for internal domestic screens and mosquito nets, it can be necessary that h<30 mm. From this it also derives, as will be seen afterwards in greater detail, the extreme importance that the cable 5 is capable of being wound on small diameters of pulley 14 without fatigue.

As described, the system 1 of the embodiments of FIGS. 1 and 6 is arranged as a simple-effect system in which the cursor return is guaranteed, instead of a counter-pressure generated by the channeling and controlling means of the control fluid in the second chamber of tube 5, like in systems 1 according to variations that will be described below, by the elastic return of the torsion spring that rewinds the mobile screen 2 onto the winding drum 3, or by gravity for ascending vertical mobile screens, such as for example a car glass. As an example, two different operating systems can be located, the opened-closed one and the one with intermediate position.

The opened-closed system is typically the one of a mosquito net, which has no need of being stopped in an intermediate position, and is made with channeling and controlling means comprising, for example, a normal 3/2 valve (three ways, two positions). If instead an intermediate stop has to be realised for the mobile screen 2, it is possible to proceed in two ways: in the first one, that is not advisable, it is enough to put a two-way valve, also of the opened-closed type, in series with the control fluid supply, and with this valve block the amount of fluid in the tube 5. Such arrangement however, in a more intelligent system, can find a surprising usefulness: suppose for example that an extended plant is present, of the type for hotels or offices; with the plant ageing, small leakages can occur, which, if individually are not worrying, as a whole would compel the compressing means of the control fluid to continuously work. Moreover, given their reduced sizes (being due to wear and not to a failure), such leakages become difficult to locate. If the mobile screen 2 is equipped with a position sensor on the winding drum 13, of the encoder or potentiometric or other type, and this sensor is able to communicate with central controlling and managing means, it is possible, for example during the night, to take the mobile screen 2 to any position and seal the control fluid entry duct in the tube 5. After the time interval $D_T$ has elapsed, it will be enough to read the movement $D_X$ performed by the system 1 in order to be able to accurately measure the leakage amount according to the rule:

$$V[\text{nl/s}]=(D_X/D_T*(d\hat{}2*P_i)/4)*10E-6*P$$

where:

V is the leakage speed in normal-liters per second;

$D_X$ is the movement in mm of the system 1;

$D_T$ is the elapsed time in seconds;

D is the diameter of tube 5 in mm;

P is the operating pressure;

and to thereby make maintenance intervene exactly on the system 1 in which the leakage has occurred when it first occurs.

Figure 3:
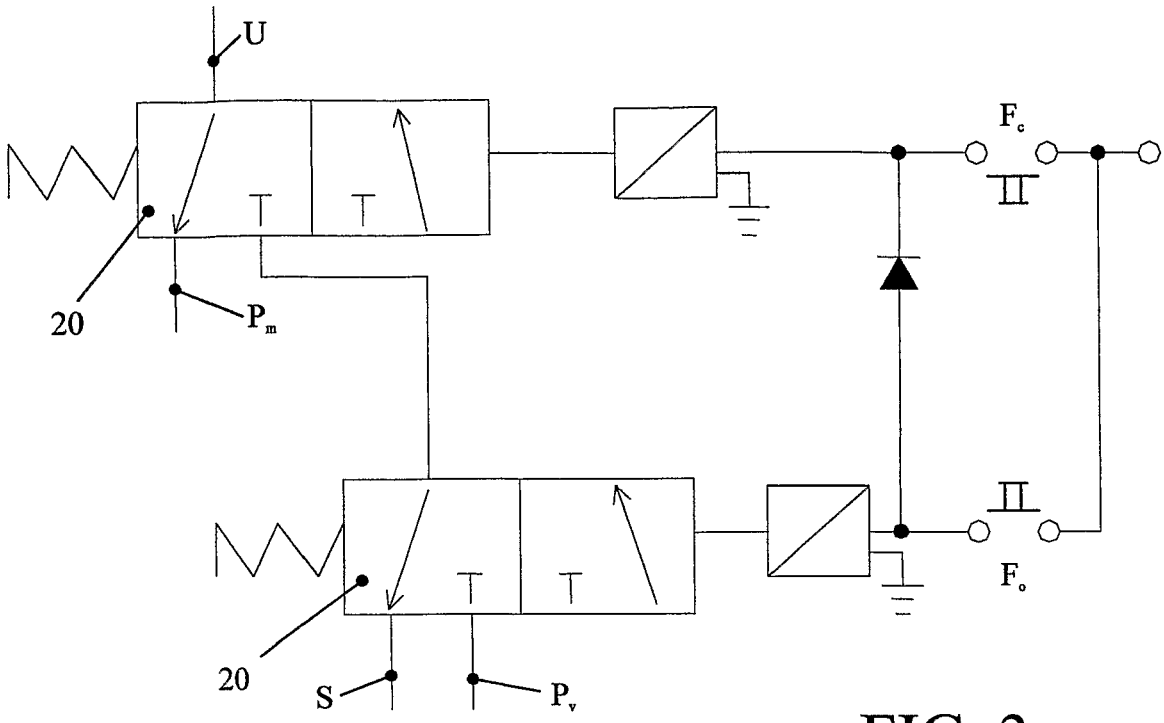
FIG. 3 shows a block diagram showing an embodiment of channeling and controlling means of the system according to the present invention.

In the second more interesting way, it is necessary to realise an exemplifying logic as shown in FIG. 3 in which Pv, S, Pm and U designate the control fluid ducts respectively related to driving pressure, operating pressure, use and discharge, and Fc and Fo designate the supply outlets of the control fluid of the channeling and controlling means aimed to impart the two opposite opening and closing movements of the mobile screen 2: in this case, by suitably driving the valves 20 through a very simple logic, it is possible to put the chamber into discharge Fo (the mobile screen 2 is opened), or to supply it at an intermediate pressure value that is enough to keep it in an intermediate position. In this case, one is exactly under the same condition in which a screen counterbalanced by a weight would be, namely with a constant balancing force. It is true that the mobile screen 2, by descending, further loads the torsion spring of the winding drum 3, thereby increasing the recall force, but it is also true that by so doing the weight of the unwound mobile screen 2 increases, and this opposes the recall force of the spring itself.

Experience demonstrates that, due to the action of frictions that anyway tend to keep the mobile screen 2 unmoving in any position, the load variability, if balanced by a suitable constant force, is such as not to be enough to win the static friction that is necessary to make the screen move in a preferred direction. Not only, but experience teaches that such friction is enough, with a suitable product design, to keep the variability range very wide for the force (and therefore the pressure) to be applied. In this operating case, therefore, it is possible to keep the mobile screen blocked in a closed position going on supplying it with full pressure, or stopping it in an intermediate position, however allowing to go on manually adjusting it. The same system, being insensitive to the gravity force direction, can work indifferently on horizontal winding screens of the "door" type like the one shown as an example in FIG. 6, or on horizontal or slanted screens of the "roof window" type.

Figure 2:
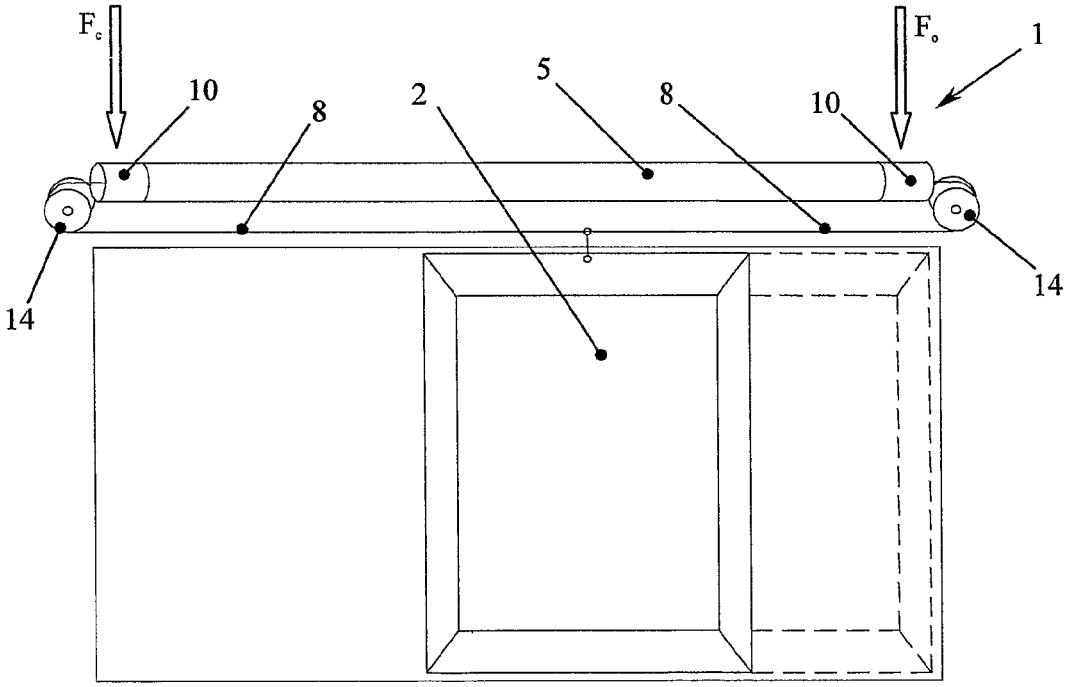
FIG. 2 shows a schematic view of another embodiment of the pneumatic automation system for mobile screens according to the present invention.

FIG. 2 shows an application of the system 1 to a type of mobile screen 2 with horizontal movement such as, for example, traditional curtains, Venetian curtains, pleated and band curtains, sliding doors or windows.

In this preferred embodiment, the above pneumatic actuator means of the mobile screen 2 movement are a tube 5, preferably arranged parallel to the architrave of an opening, inside which at least one cursor slides: in this case, the cable 8 connected to the cursor goes preferably out of both opposite openings of the tube 5 through two different closing elements 10 to be returned by two return element of pulleys 14 in order to be connected to the mobile screen 2. In this embodiment, the pressurised air is suitably conveyed inside the above first and second chambers by the system of valves and ducts, representing the above fluid channeling and controlling means like the ones in FIG. 3, according to the movement that has to be imparted to the mobile screen 2.

As described, the system 1 of the embodiment of FIG. 2 is thereby configured as a double-effect system in which the cursor movement inside the tube 5, and consequently the movement of the mobile screen 2 connected therewith, are generated by the channeling and controlling means of the control fluid, entering the pressurised control fluid suitably in the first or second chamber: therefore, by entering the pressurised control fluid in the tube 5 of the first chamber according to arrow $F_c$, the cursor will be taken to move rightwards in the Figure and consequently the mobile screen 2 to be moved leftwards; obviously, by entering the pressurised control fluid in the tube 5 in the second chamber according to arrow $F_o$, opposite movements will be obtained. It is clear that what precedes can be applied also to vertically-moving mobile screens 2 that require a double-effect system. Double-effect systems can be efficiently controlled with channeling and controlling means comprising five-way valves; in particular, in systems 1 in which only all-open or all-close position are interesting (screens for mosquito nets, shop windows) and that must be kept efficiently in position, 5/2 (five ways two positions) valves find an ideal application.

Instead, in systems of the type with disappearing sliding doors, drawers, horizontal or vertical darkening curtains, that must have the chance of stopping in an intermediate position, 5/3 valves are advisable, but it is necessary to distinguish: if mobile screens 2 must be kept strongly in place when they are stopped in an intermediate position, valves with closed centers will be necessary; if instead it is desired that the mobile screens 2 can be freely moved even manually, valves with open centers have to be used. In the first case, with unmoving mobile screen 2 in an intermediate point, the first and second chambers formed on the two sides of the tube 5 are sealed, and any manual manoeuvre attempt generates a pressure increase in the chamber that tends to be reduced, such pressure increase generating such a force as to counteract the cause that generated it, tending to keep the mobile screen 2 in place; in the second case, the chambers in an intermediate position are both open at atmospheric pressure and consequently it is possible to freely move the mobile screen 2 without any resisting effect. In both cases, anyway, it is possible to override the system 1 blocking the mobile screen 2 in a completely closed or completely open position. It is advantageous to note that in no application of the system 1 limit switch devices are necessary to avoid damages to the system 1, since reaching the mechanical abutment does not cause any damage, even if kept for a long time, such thing unavoidably destroying an, electric device if the limit switch does not operate or is badly adjusted. In case of a system with open centers, keeping in place the unmoving screen in an intermediate point is guaranteed even only by frictional forces.

Obviously the above-mentioned configurations of the channeling and controlling systems of the control fluid are merely a non-limiting example since, for example, more complex valving systems can be made that are aimed to realize different functionalities in a pneumatic logic. For example, it is possible to realize channeling and controlling means that are able to simultaneously manage a plurality of systems 1, possibly derogating their control and management to central controlling and managing means according to predefined logics, as will be stated below when detailing as an example some possible applications of the system 1 according to the present invention. In systems 1 with mobile screens 2 with vertical movement with simple or double effect it is possible that, when the mobile screen 2 is unmoving in an intermediate position, the spring return force and possible control fluid leakages make it undesirably progressively rise: in order to solve this problem, it is possible to provide an arrangement of the channeling and controlling means, like the one always shown in FIG. 3, that is able to supply control fluids to the first chamber of tube 5 with a keeping pressure that, with the help of the internal friction between cursor, its second sealing means and the tube 5 itself, the sliding friction of the mobile screen 2 in the sliding guides, the rolling friction of the winding drum 3 and the friction due to mobile screen 2 rubbing when going out of the winding drum 3, is able to ensure that the desired position is kept by the mobile screen 2.

Systems that can seem alike the one according to the present invention already exist in industrial applications, but they have now almost completely be abandoned due to their use limits in such sector and due to conceptual defects that hae been solved by the present invention.

First of all, industrial systems typically needed high forces and stiffnesses, and for such reasons the cylinders had big diameters: in the case of the present invention, instead, the pneumatic actuator means or tubes have diameters of few tents of millimeters; moreover, given the extreme difficulty of creating a perfect and reliable seal on a perfectly smooth cable with small section, industrial systems with single-wire steel cables were used with a diameter of a few millimeters.

Unfortunately, the reversal at tube outlet, having to occur on a pulley, generated an early fatigue ageing on the cable, unless big, encumbrant and costly pulley diameters were used.

In the system 1 according to the present invention instead a long-life, perfect-seal, high-stiffness cable 8 is used, that is able to be wound on pulleys 14 with small diameter without being subjected to materials fatigue. The cable 8 in fact is preferably a composite element comprising a plurality of layers that, starting from the center towards the outside, appear as follows:

- a multi-wire core, with extremely thin fibers to minimize the fatigue effect, realised with a high-stiffness material such as, for example, stell, aramide fiber, glass fiber, carbon fiber, polyethylene fiber;
- a finely-worked braid, typically not threaded or ritorted, of a material adapted to realise a cylindric containing element that is able to slide on the internal core (to minimise fatigue in bends) and to strictly adhere to the following layers, in order to make the cable 8 section perfectly circular and to contain the core inside it;
- a spreaded layer of smooth and elastic coating material, for example polyamide, polyethylene, polypropylene or other materials with suitable characteristics, adapted to strongly adhere onto the underlying layer, smoothing the fabric working asperities, and to adhere and/or be spreaded by the following layer;
- a preferably dry layer of lubricant such as, for example, molybdenum bisulfide or graphite, adapted to strongly adhere and/or be spreaded in the underlying layer, thereby completing the action of smoothing the asperities, such as surface micro-roughnesses, of the previous layer, and realise a perfect sliding surface on the second sealing means.

In the specific case, an assembly has been realised that is able to transfer forces greater than 200N (screen tension over 400N), to slide at speeds greater than 1 m/s, for 20,000 two-meter strokes, by reverting the direction on a pulley with a diameter of 15 mm, with a wire with only 1 mm of diameter, with a cylinder of only 10 mm of diameter before showing the first signs of yielding.

The above-mentioned values not only make the system 1 according to the present invention an ideal product for the application described as an example, but make it a candidate, possibly in cooperation with the central controlling and managing means, to be integrated in a complete system for environmental management (energy saving), to be used for accessing a shop in place of automatic sliding doors, to move sliding doors in place of costly electric motors; moreover, due to the flexibility of cable 8 and its extremely reduced overall sizes, the system 1 according to the present invention allows taking an automatic movement in places that are accessible with difficulty such as for example interiors of doors for maneuvering locks or rolling gates for conditioning systems, in domestic automation systems for the driven manoeuvre of doors, cupboard wings, drawers, etc., as help for handicapped people, being able to be realised with costs that are equal to a fraction of those that are currently possible and with better operating reliability and silence. Last but not least, the uses in motor vehicle fields, in which the system 1 could find use in automating the opening of windows (in a more inexpensive way than the current one) till the automatic opening and closing of doors.

Due to the high reliability and endurance demonstrated, by equipping the system 1 according to the present invention with suitable sensors and suitable control intelligence defined by central controlling and managing means or integrating a plurality of systems 1 inside an integrated central control system equipped with central controlling and managing means that cooperates with various sensors and commands, the individual channeling and controlling means and one or more control fluid compressing means, it is possible to realise an interesting result in a more and more important and up-to-date context, like the energy saving one. For such purpose, two classical situations can for example occur:

full summer, the sun widely enters form the windows and due to the well-known greenhouse effect, visible and near infrared radiation that finds transparent glasses when entering, finds them opaque when it is converted in thermal infrared far from the partial reflection from inside the room and is trapped inside, raising the room temperature and obliging the conditioners to perform a useless work, avoidable if only one has lowered an external reflecting screen;

full winter, in particular in a not-cloudy night: as known, heat transmission by radiation between two sources is proportional to the square of the temperature difference; in the classical case of a night with stars, the room interior, typically at 293° K (20° C.), is interfaced through the glass directly on the bottom universe temperature of 3° K and the propagation coefficient is not equal to 84100, but if along its route the radiation found an external screen at the temperature (assuming a cold night with −10° C.) of 263° K, the coefficient would only be equal to 900 with a drastic reduction of the radiation effect. Minor, but always clear advantages, would be obtained in case of a cloudy night with a mean cloud temperature of −40° C. (233° K) in which the interior "would see" a heat source at that temperature and therefore there would be a coefficient of 3600, with a less evident, but anyway optimum result.

It is then necessary to ask why the existing screens, given the evident advantages that their closure in certain situation would provide, in practice are very rarely closed. Certainly, a first answer is laziness; moreover, it would be unthinkable having to adjust the screen as "all opened" or "all closed" every time one goes away from the room, since, when there are people in a room, it is obvious that the visual comfort of people is more important than energy considerations. It goes without saying that, by equipping the screens with a position sensor as mentioned above, the rooms with a presence sensor, and the building with an external and radiation temperature sensor (or a plurality of each one of them), it is possible for controlling and managing means to interact with one or a plurality of systems 1 for adjusting the mobile screens 2, for example according to the following priority scale:

1) if there is a person in the room, he has priority for adjusting the light as he wishes, with pushbutton commands or manually. It is also possible at that time, with a further internal brightness sensor placed in the room, to provide that the system 1 automatically adjusts the opening in order to keep the amount of light entering the room constant;

2) if there is no one any more in the room for a predefined time deemed as enough, the central controlling and managing means interact with the systems 1 through the channeling and controlling means in order to adjust the mobile screens 2 on an all-opened or all-closed position according to external environmental conditions;

3) if again a presence is detected inside the room, the conditions left by the user when he went out are restored in a few seconds (on the order of 1-2 s).

Basing on statistical presence data and on the reflecting capability of currently marketed cloths (greater than 70%), by using one or more systems 1 according to the present invention, possibly automatically controlled by the central controlling and managing means, it is possible to estimate a 15% saving on heating costs and a 30% saving on conditioning costs.

With an integrated system of this type, it is thereby possible to realise, through controlling and managing means equipped with a suitable central control intelligence, applications with multiple possibilities.

As a non-limiting example, the central controlling and managing means and/or the individual systems 1 through the channeling and controlling means can operatively interact with positions sensors of the winding drum 3, external temperature sensors, internal temperature sensors, radiation sensors, presence sensors, movement sensors and/or internal brightness sensors.

As an example, some of the numerous applications in which the use of system 1 shows undoubted advantages are listed below:

anti-theft system in two versions:

a) by measuring position variations of the winding drum 3, it is possible to detect whether from the outside one is attempting to force the opening and activate an alarm;

b) it is possible to use the internal movement sensor for providing an alarm:

b.1) directly like in a normal anti-theft device;

b.2) only if the mobile screen 2 has been tampered with, thereby allowing to freely move inside the house, and providing an alarm due to a movement only in the rooms that afterwards can be deemed as menaced, with a drastic reduction of false alarms, due to the pre-alarm on the mobile screen 2 that occurs form the movement of the "encoder" type sensor that checks the winding drum 3 position;

c) automatic check of internal environmental brightness depending on external brightness conditions (a frequent case is when engaged in a work or in reading, a person gets more and more fatigues when reading and then suddenly realises that he is practically in the dark due to changed external conditions);

d) if suitably integrated to the chance of driving electric lights, one can pass, with all advantages from the visual comfort and the energy saving point of view, continuously from natural light, making it preferred, to artificial light, integrating only what is necessary;

e) windows of refrigerated exhibition devices: currently refrigerating windows are of two types, with glass door for closing the freezing cells or totally opened for simply-cooling cells. The first ones are uncomfortable, relatively costly but efficient in terms of energy saving, the second ones, being open towards the environment, are extremely wasting from the energy point of view: these latter ones are normally equipped with a winding screen that is however closet only during the night, since it would prevent the product vision and it is unthinkable that the customer controls it manually.

Figure 4:
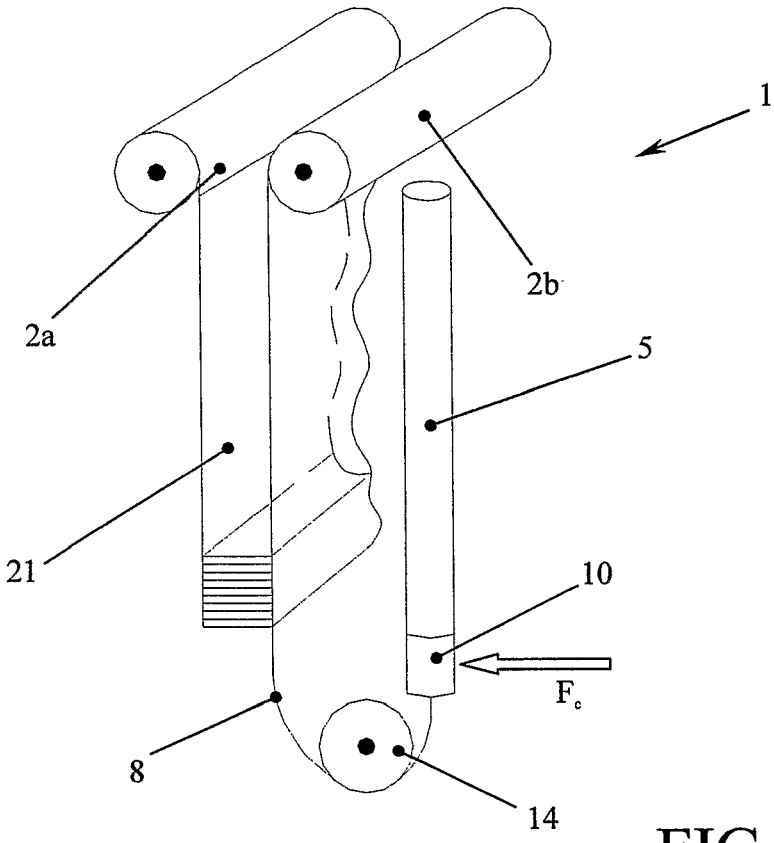
FIG. 4 shows a schematic perspective view of another embodiment of the pneumatic automation system for mobile screens according to the present invention.

The system 1 according to the present invention, using as mobile screen 2 a transparent sheet, made of, for example, Mylar, PVC-crystal, an elastomer or a polycarbonate or any other transparent material adapted to be wound onto a winding drum 3, could efficiently perform its function, allowing to see the product and managing an automatic opening and closing by means, for example, proximity sensors, actuating pushbuttons, etc. No safeties would moreover be required, since the closing force can be adjusted on absolutely not dangerous values. If the refrigerator temperature is lower than the environmental dew point, the condensate problem on the external wall of the transparent sheet can be solved by making a double wall with insulating chamber 21 by unwinding two opposed mobile screens 2*a*, 2*b* as shown in FIG. 4. Moreover, in service refrigerating benches 23 like the one schematically shown in FIG. 7, that can be found for example in butcher's shops, the thermal insulation is guaranteed by the air layering effect given the well-shaped configuration, but the products 25, in this case meat, are always exposed to an unhygienic contact risk with insects: by providing therefore the access opening by an operator with the system 1 according to the present invention having a mosquito-net mobile screen and the refrigerating bench 23 with a suitable control member 27 for channeling and controlling means, for example with pedal, it is possible to solve such inconvenience, semi-automatically opening and closing for a few seconds the access;

f) applications on small sizes can be the protection of dangerous parts of industrial or domestic tooling (for example a mobile screen 2 of the network type could be automatically made descend around kitchen fires in order to prevent children from approaching, or in front of a machine tool that projects cooling liquids or to avoid the accidental introduction of operator's hands), or as automatic opening of the motor-way fare payment barriers (in order to prevent heated or conditioned air from going out).

Figure 5:
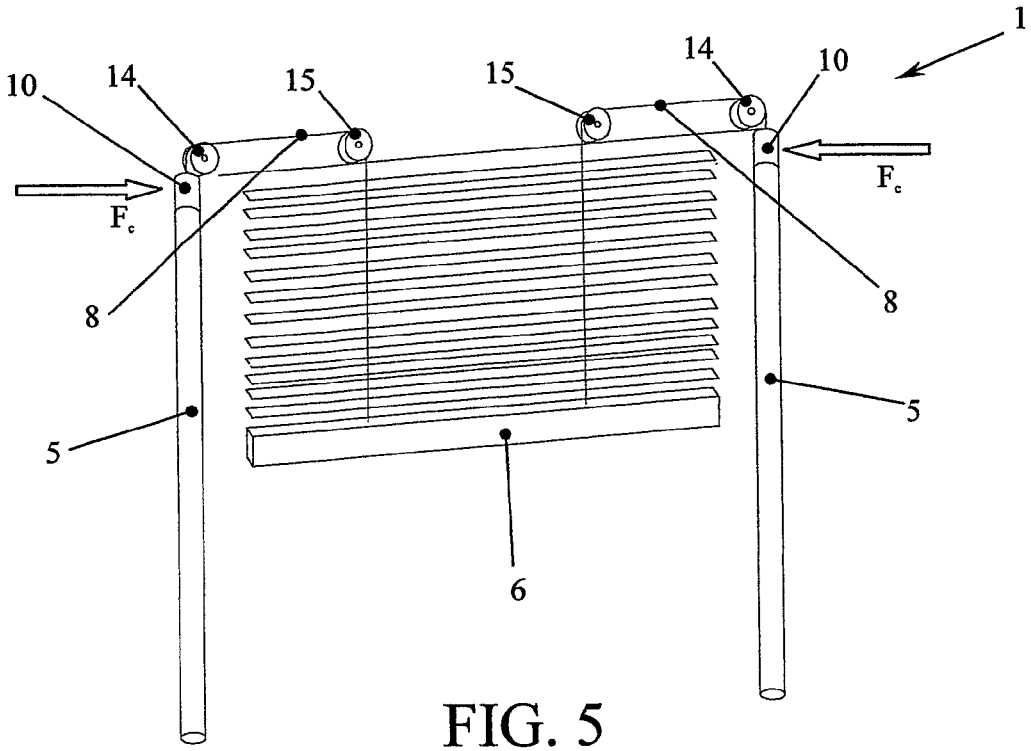
FIG. 5 shows a schematic view of another embodiment of the pneumatic automation system for mobile screens according to the present invention.

From what is stated above, it is clear that the advantages deriving from the use of a system 1 according to the present invention are extremely numerous, measured in terms of:

reliability, due to the fact that the control fluid compressing means can be easily dimensioned in terms of size/power ratio; moreover, using an air compressor as control fluid compressing means, due to the capability of air to store energy, it can asynchronously operate by using the mobile screen 2: therefore, by loading a small air bottle, its energy can be quickly withdrawn with used power peaks that are even tenths of times greater than the employed one; for example, a bottle with a capacity of only one liter guarantees alone (without starting the compressor up) up to twenty simultaneous drives of mobile screens 2 covering normally-sized windows. Moreover, with an average life of at least 10,000 cycles of the pneumatic system, a practically eternal system is obtained for domestic applications. Due to its reliability and a very long operating life, the system 1 is extremely adapted to operate for applications with reflecting screens aimed to energy saving, these applications requiring a continuous check of the mobile screens 2 position that is unthinkable or materially unfeasible with other known systems;

operating silence: using, for example, a compressor of the refrigerator-type, there is the same noisiness of a running refrigerator, this being therefore quite acceptable in a domestic environment, and moreover it can be placed every where, particularly far from sleeping rooms and the like;

reduced costs;

simple adjustment of movement speeds of mobile screens 2 creating a diameter reduction on the control fluid supplying duct of the channeling and controlling means. It is further possible to adjust the maximum system force to safety value that are deemed suitable case by case, by simply adjusting the supply pressure delivered by the compressing means. The mobile screen 2 can however reach movement speeds equal to one meter per second and over, though controlling the force. Moreover, the system 1 has no moving inertial masses, an advantage for safety;

absence of limit switches, since the system 1 can remain in a mechanical end-of-stroke condition indefinitely without consequences. Moreover, when used in the position control function, it can remain unmoving indefinitely in any point, anyway allowing the manual check by possibly directly operating on the mobile screen 2. However, when set to the closed position, it can exert all the keeping force, compelling to provide a picking operation (necessary for insurance coverage) in order to be able to open the mobile screen 2;

absence of electric sources or electric devices on the system 1 but only low-pressure compressed control fluid: consequently, the system 1 could easily operate also during an immersion;

possibility of exerting a high tensioning force on the mobile screen 2, making the system 1 adapted to horizontal roof openings, and in external applications, being strongly in sensitive to wind;

absence of skilled personnel for installation: the necessary ducts of the channeling and controlling means for the connection can have sizes comparable with those of electric cables in current systems (diameter of about 3 mm), but do not require skilled labour for their setting-up;

control means de-location with respect to the mobile screen 2: due to the extreme flexibility of cable 8, the tube 5 can also be placed far from the point in which the force is applied on the mobile screen 2, taking it then in situ through a system of transmissions or pulleys; for example, with reference to FIG. 5, it is possible to note that a curtain of, the Venetian type could be arranged above its own box and the cable 8 taken to the handle bar 6 through the Venetian blades by means of pulleys 15;

simple use configuration: a single tube 5 can control a plurality of cables 5, if it is necessary, in particular applications, to have perfectly synchronous movements, as shown in FIG. 6. Cables 5 in fact, due to their high flexibility, can then be returned through pulleys 15 where a movement is necessary.

This also due to the reduced sizes of the sealing system that allows a plurality of cables to pass even in very small heads.

What is claimed is:

1. A pneumatic automation system for mobile screens, the pneumatic automation system comprising:

at least one mobile screen;

means for compressing a control fluid;

means for channeling and checking the control fluid;

means for pneumatically actuating a movement of the mobile screen equipped with at least one sliding cursor controlled by the control fluid and supplied by the compressing means through the channeling and checking means, the means for pneumatically actuating being at least one tube adapted to operate as a pneumatic cylinder, the tube containing at least one of the cursors adapted to slide inside the tube, the tube being divided into a first chamber and a second chamber by the cursor; and means for connecting the cursor to the mobile screen;

wherein the cursor comprises a tank for a lubricant to be dispensed inside the tube, the tank being closed by a grease-pressing plate adapted to slide inside the tank and to press the lubricant inside the tank, the cursor being equipped with at least one hole communicating with the tank through which the lubricant is adapted to go out and lubricate the tube.

2. The pneumatic automation system of claim 1, wherein at least one end of a side of the mobile screen is connected to the cursor through the connecting means.

3. The pneumatic automation system of claim 1, further comprising a handle-bar.

4. The pneumatic automation system of claim 3, wherein at least one side of the mobile screen is linked to the handle-bar.

5. The pneumatic automation system of claim 3, wherein each one of two opposite ends of the handle-bar is connected to at least one of the cursors through the connecting means.

6. The pneumatic automation system of claim 1, wherein the connecting means comprise at least one cable.

7. The pneumatic automation system of claim 6, wherein the cable is made of a multi-layer composite material.

8. The pneumatic automation system of claim 1, wherein the at least one mobile screen is sliding.

9. The pneumatic automation system of claim 1, wherein the at least one mobile screen is able to be rolled.

10. The pneumatic automation system of claim 1, wherein the at least one mobile screen is able to be grouped as a package.

11. The pneumatic automation system of claim 1, wherein the at least one mobile screen is a darkening screen or a sun screen or a thermal screen or a curtain or a mosquito-net.

12. The pneumatic automation system of claim 1, wherein the fluid compressing means and the channeling and checking means of the fluid are adapted to generate a pressure difference between the first chamber and the second chamber.

13. The pneumatic automation system of claim 1, wherein the channeling and checking means comprise a plurality of ducts, a plurality of valves and a plurality of sealing means for the fluid.

14. The pneumatic automation system of claim 1, further comprising a position sensor adapted to determine a position of the mobile screen.

15. The pneumatic automation system of claim 1, wherein the channeling and checking means cooperate with means for centrally controlling and managing the channeling and checking means.

16. The pneumatic automation system of claim 15, wherein the channeling and checking means and the central control and management means are operatively connected to sensors.

17. The pneumatic automation system of claim 16, wherein the sensors include one or more selected from the group consisting of position sensors, proximity sensors, external temperature sensors, internal temperature sensors, radiation sensors, presence sensors, movement-sensors and internal lighting sensors.

18. The pneumatic automation system of claim 1, wherein the fluid is a gas, air or a liquid.

19. An integrated central control system adapted to control and manage one or more pneumatic automation systems for mobile screens, the integrated central control system comprising:

one or more pneumatic automation systems for mobile screens comprising:

at least one mobile screen;

means for compressing a control fluid;

means for channeling and checking the control fluid;

means for pneumatically actuating a movement of the mobile screen equipped with at least one sliding cursor controlled by the control fluid and supplied by the compressing means through the channeling and checking means, the means for pneumatically actuating being at least one tube adapted to operate as a pneumatic cylinder, the tube containing at least one of the cursors adapted to slide inside the tube, the tube being divided into a first chamber and a second chamber by the cursor; and means for connecting the cursor to the mobile screen;

wherein the cursor comprises a tank for a lubricant to be dispensed inside the tube, the tank being closed by a grease-pressing plate adapted to slide inside the tank and to press the lubricant inside the tank, the cursor being equipped with at least one hole communicating with the tank through which the lubricant is adapted to go out and lubricate the tube; and central control and management means operatively connected to sensors, the channeling and checking means and the means for compressing the control fluid.

* * * * *